US005573275A

United States Patent [19]

Smith et al.

[11] Patent Number: 5,573,275

[45] Date of Patent: Nov. 12, 1996

[54] IN-LINE SKATE GUARD

[76] Inventors: Bruce C. Smith, 26 Rowley Avenue, Toronto, Ontario, Canada, M4P 2S8; Christopher A. Hardie, 120 Everden Road, Toronto, Ontario, Canada, M6C 3K8

[21] Appl. No.: 499,655

[22] Filed: Jul. 7, 1995

[51] Int. Cl.[6] ..... A63C 17/20

[52] U.S. Cl. ..... 280/825; 280/811; 36/132

[58] Field of Search ..... 280/11.22, 825, 280/811; D21/226, 230; 36/132, 136

[56] References Cited

U.S. PATENT DOCUMENTS

| | | | |
|---|---|---|---|
| 2,700,832 | 2/1955 | Slovinski | 36/132 X |
| 4,252,345 | 2/1981 | Cabral | 280/825 |
| 4,382,616 | 5/1983 | Olivieri | 280/825 |
| 5,290,065 | 3/1994 | Kassal | 280/11.22 X |
| 5,303,955 | 4/1994 | Zurnamer | 280/825 |
| 5,503,433 | 4/1996 | Lachapelle | 280/11.22 X |

FOREIGN PATENT DOCUMENTS

| | | | |
|---|---|---|---|
| 2065834 | 10/1993 | Canada . | |
| 2740681 | 3/1979 | Germany | 280/825 |
| 573729 | 3/1976 | Switzerland | 36/132 |

OTHER PUBLICATIONS

"Toe Jam"—Newsweek, Jul. 24, 1995, p. 6.
Advertisement sheet for Blade–Blox, pub. date unknown.

*Primary Examiner*—Brian L. Johnson

*Attorney, Agent, or Firm*—Donald E. Hewson

[57] ABSTRACT

A guard for use on in-line roller skates, to permit the wearer of the in-line roller skates to be safely ambulant comprises a main body portion, a substantially solid base member, opposed left and right substantially rigid side walls extending upwardly from the base member so as to define a wheel-receiving trough above the base member, and a ground contacting bottom surface. First and second loop-shaped securing members are connected to the main body portion for looped engagement around the toe portion and rear portion respectively of the boot of the skate. In a first embodiment, forward and rearward blocking portion are disposed on the main body portion, such that when the guard is in place on the in-line roller skate, the forward and rearward blocking portion are disposed forwardly and rearwardly, respectively, of at least one of the wheels of the in-line roller skate in intimately contacting relation therewith, so as to generally preclude fore and aft rolling motion, respectively, of the in-line roller skate along the base member. In a second embodiment, the first and second side walls each comprise a generally frictional top surface shaped to receive the elongate rail portions of the wheel receiving frame of the skate, in weight bearing relation, without the wheels of the in-line roller skate touching the base member.

16 Claims, 5 Drawing Sheets

IN-LINE SKATE GUARD

FIELD OF THE INVENTION

This invention relates to skate guards, and more particularly to guards for use on roller skates, specifically in-line roller skates.

BACKGROUND OF THE INVENTION

Roller skating has been a popular past-time for many years. It is done both indoors, typically on a suitably prepared wood or concrete surface, or outdoors, on roads or parking lots, or the like. In recent years, in-line roller skates have become very popular, largely because they more closely simulate the action of skating on ice using ice skates. In-line roller skates may be used either indoors or outdoors, but are much more commonly used outdoors. It is common to use in-line roller skates outdoors as a form of recreation or exercise, and also as a form of transportation, such as for a quick trip to the store.

There are two significant problems, however, associated with using in-line roller skates as a means of transportation. The main problem is that it is not easy to stop suddenly or quickly with in-line roller skates—in fact, it can be quite difficult. It is much more difficult to stop, or to control a stop, with in-line roller skates than with ice skates. Further, it is quite easy to unexpectedly or unwantedly slip with in-line roller skates. Secondly, it is common to encounter floors that are not quite level or are bumpy or uneven, or doorways with runners at the bottom, or floormats, or even to meet the necessity to climb up or climb down stairs, and so on. Accordingly, it is quite common for a wearer of in-line roller skates to slip, stumble or fall. While such slipping, stumbling or falling might not be a significant problem in general, if appropriate protective gear is worn, it certainly can be a significant problem in a public location such as a store. While it may be possible to navigate slowly and carefully around a store, there is a good chance that even a relatively experienced in-line roller skate user could slip or run into another person, thus potentially causing injury to the in-line roller skate user or the other person, or perhaps damage to a display or the like.

Once a wearer of in-line roller skates is at a destination, various obstructions, such as those named above, must be dealt with, or alternatively, the in-line roller skates must be removed. Removal of the in-line roller skates is generally undesirable as it is virtually necessary to carry a pair of shoes, since bare feet are usually prohibited in stores and the like.

Moreover, it is now commonplace for stores and the like to prohibit anyone wearing in-line roller skates from entering the premises. Indeed, in some areas there are by-laws against wearing in-line roller skates in public places, shopping malls, stores and so on.

What is needed is a means by which in-line skates can be worn in a public place, stores, or the like, where in-line skates are either prohibited or it is undesirable to wear them, without removing in-line roller skates.

DESCRIPTION OF THE PRIOR ART

Various types of ice skate guards are known. Typically, such ice skate guards are made from a relatively hard plastic material, and have a relatively straight main body portion with an upwardly curved portion at the front end thereof. The upwardly curved portion is shaped to receive the front end of the skate blade. An elastically deformable strap connected to the main body portion loops around the rear of the skate blade to hold the skate guard on the skate blade. The actual blade of the skate is received in a race in the skate guard, with the bottom of the blade intimately contacting the bottom of the race in weight bearing relation. This particular type of design is not suited for use as a guard for use with in-line roller skates, however, even with appropriate size adaptation. Ice skates have a concave lower surface, and only the edges (or, usually, only one of the edges) contacts the ice surface as the skate passes thereover. Propulsion is due to the skate edge biting or cutting into the ice surface. An ice skate guard is put on the skate blade by placing the rear of the blade under the deformable strap and pushing it backwards to permit the front end of the blade under the deformable strap and pushing it backwards to permit the front end of the blade to rest into the front of the guard. The blade is held in place by the elastic strap, and will not slide in the guard because of friction between the edges of the lower concave surface of the blade and the material of the guard. In-line skates, on the other hand, rely on a friction contact between the outer surface of each of the wheels and the surface being skated upon, but also require a nearly frictionless bearing at the axis of each wheel. Thus, the wheels of the in-line roller skate would roll along the bottom of the race, thus making the in-line roller skate unstable in the guard.

Further, due to the formation of the wheels and the wheel receiving frame of the in-line roller skate, using a guard having an upturned front portion and a loop-shaped fastening means that looped around the rear of the in-line roller skate would not be practical since the front wheel would be unstable because it can still turn on its own axis.

U.S. Pat. No. 5,303,955 to ZURNAMER discloses an in-line roller skate guard having an envelope-shaped body of flexible material such as woven nylon. The guard is open at the top and has a rubbery bottom strip. The side panels of the guard have rear extensions that wrap around the rearmost wheel or brake of the in-line roller skate. A vertical strap of adjustable length is secured at one end thereof to the envelope-shaped body of the guard, and is removably secured at the other end thereof to the top of the back edge of the boot of the in-line roller skate by way of a clip or the like. This in-line roller skate guard has numerous problems associated with it. Firstly, due to the fact that it is made from flexible material such as woven nylon, it very readily moves when fastened in place on the in-line roller skate. Further, because there is nothing blocking the forward and rearward rolling motion of the wheels, the in-line roller skate can essentially roll within the guard, thus making the contact between the skate and the guard unstable.

Moreover, this in-line roller skate guard requires considerable manipulation and general effort to attach it to an in-line roller skate. Also, it does not provide a wide, flat, stable base for contacting the ground during walking.

SUMMARY OF THE INVENTION

In accordance with one aspect of the present invention, there is provided a guard for use on an in-line roller skate having a series of wheels rotatably mounted in an in-line configuration on a wheel receiving frame having two substantially parallel elongate rail portions and being secured to a boot having a toe portion and a rear portion. The guard permits the wearer of the in-line roller skate to be safely ambulant and comprises a main body portion having a front end and a back end and comprising a generally horizontally disposed substantially solid base member, opposed left and right substantially rigid side walls extending upwardly from the generally horizontally disposed base member so as to define a wheel-receiving trough above the generally horizontally disposed base member, and a ground contacting bottom surface. A first loop-shaped securing member is operatively connected to the main body portion and oriented in upwardly projecting relation for looped engagement around the toe portion of the boot of an in-line roller skate. A second loop-shaped securing member operatively connected to the main body portion and oriented in upwardly and rearwardly projecting relation for looped engagement around the rear portion of the boot of an in-line roller skate. At least one of the first and second loop-shaped securing members is elastically deformable so as to provide snug attachment of the guard to an in-line roller skate. Forward and rearward blocking means are disposed on the main body portion, such that when the guard is in place on the in-line roller skate, the forward and rearward blocking means are disposed forwardly and rearwardly, respectively, of at least one of the wheels of the in-line roller skate in intimately contacting relation therewith, so as to generally preclude fore and aft rolling motion, respectively, of the in-line roller skate along the generally horizontally disposed base member of the guard.

In accordance with another aspect of the present invention, there is provided a guard for use on an in-line roller skate having a series of wheels rotatably mounted in an in-line configuration on a wheel receiving frame having two substantially parallel elongate rail portions and being secured to a boot having a toe portion and a rear portion. The guard permits the wearer of the in-line roller skate to be safely ambulant and comprises a main body portion having a front end and a back end and comprising a generally horizontally disposed substantially solid base member, opposed left and right substantially rigid side walls extending upwardly from the generally horizontally disposed base member so as to define a wheel-receiving trough above the generally horizontally disposed base member, and a ground contacting bottom surface. A first loop-shaped securing member is operatively connected to the main body portion and oriented in upwardly projecting relation for looped engagement around the toe portion of the boot of an in-line roller skate. A second loop-shaped securing member operatively connected to the main body portion and oriented in upwardly and rearwardly projecting relation for looped engagement around the rear portion of the boot of an in-line roller skate. At least one of the first and second loop-shaped securing members is elastically deformable so as to provide snug attachment of the guard to an in-line roller skate. The first and second side walls each comprise a generally frictional top surface shaped to receive the elongate rail portions of the wheel receiving frame of the skate and define the wheel-receiving trough to be of a depth greater than the distance of downward projection of the wheels from the elongate rail portions of the wheel receiving frame, to thereby permit the generally frictional top surface to receive the elongate rail portion of the wheel receiving frame in weight bearing relation.

BRIEF DESCRIPTION OF THE DRAWINGS

Embodiments of this invention will now be described by way of example in association with the accompanying drawings in which.

Figure 1:
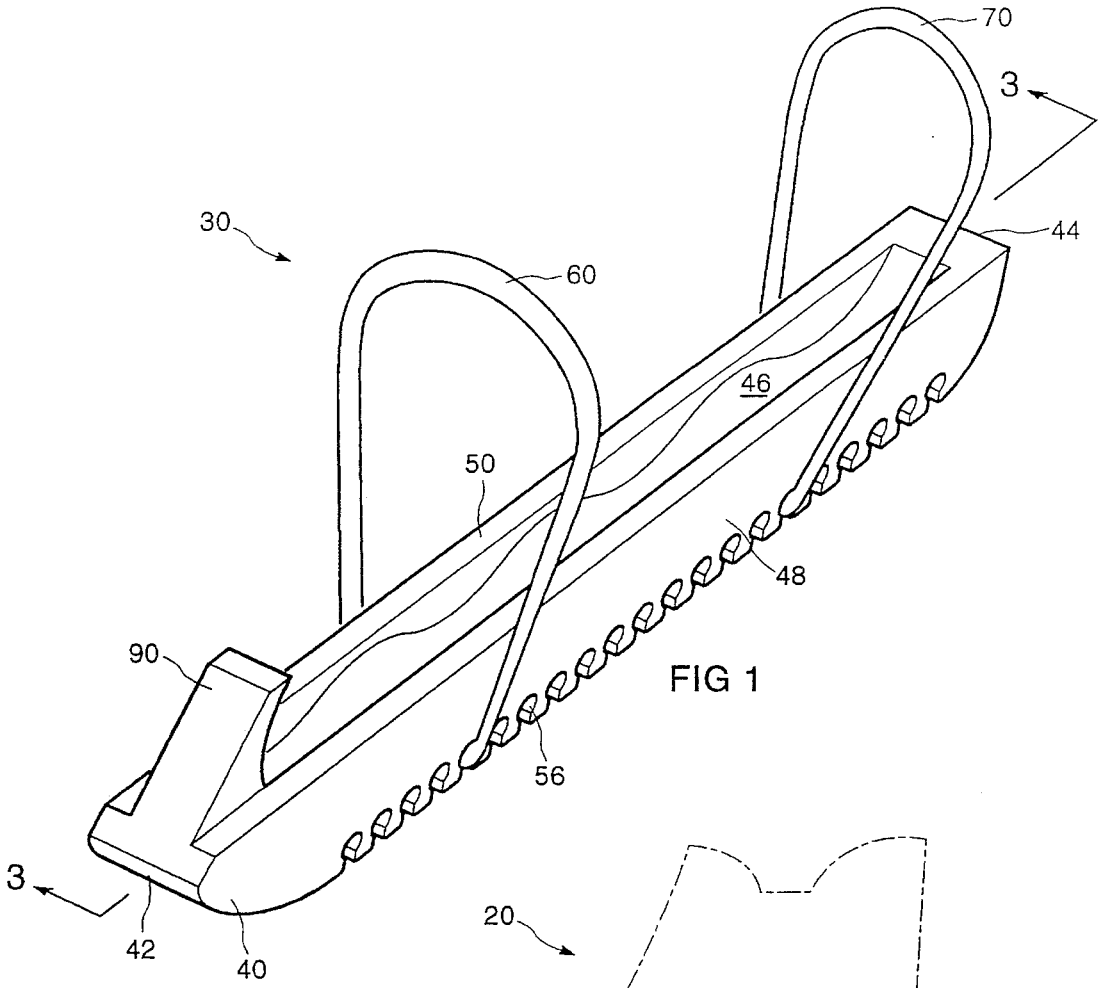
FIG. 1 is a perspective view from the front of a first preferred embodiment of the in-line roller skate guard of the present invention.
Figure 3:
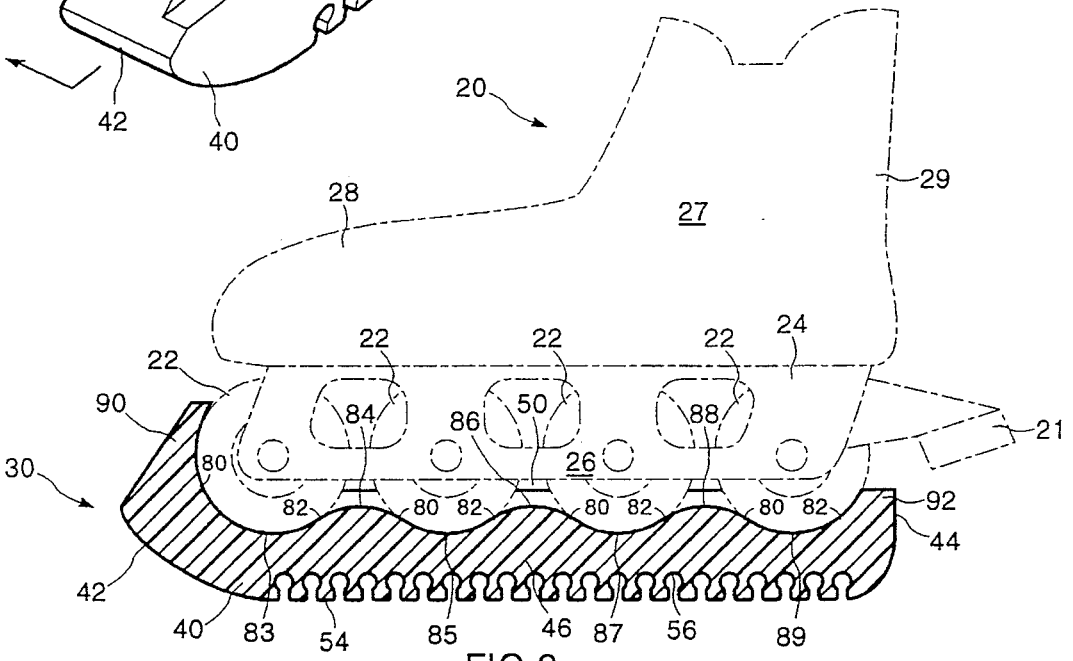
FIG. 3 is a sectional side elevation taken along section line 3—3 of FIG. 1.
Figure 2:
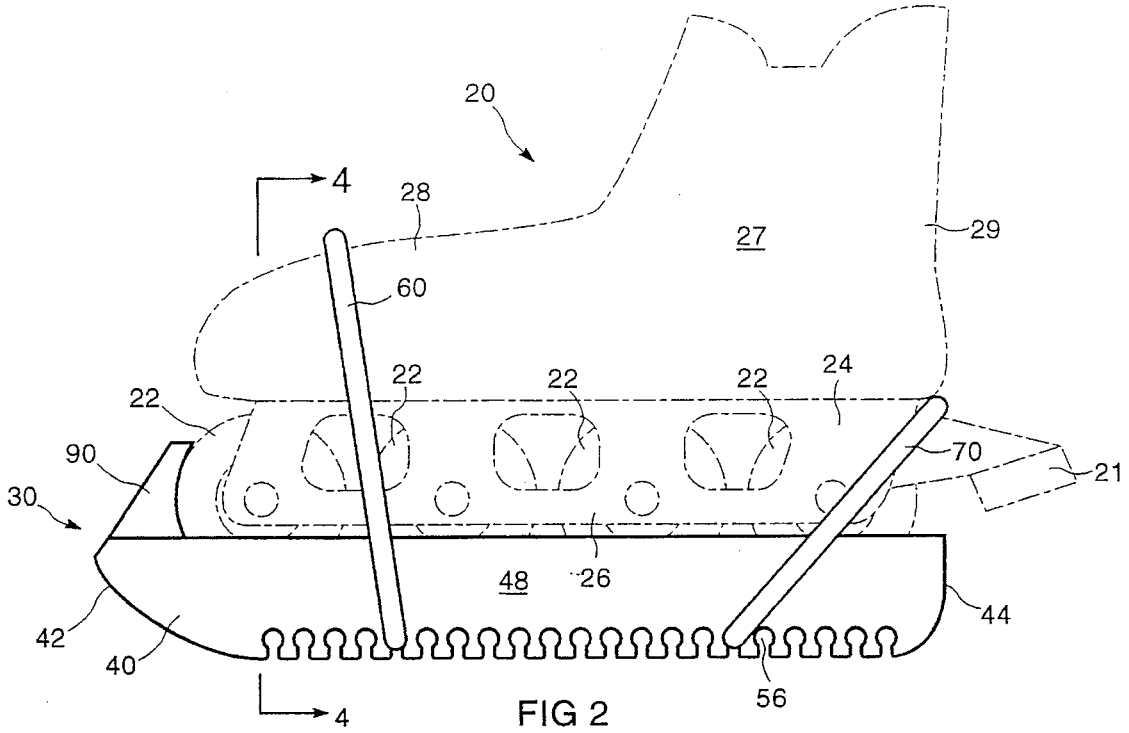
FIG. 2 is a side elevation of the guard of FIG. 1, attached to an in-line roller skate, with the in-line roller skate shown in ghost outline.
Figure 4:
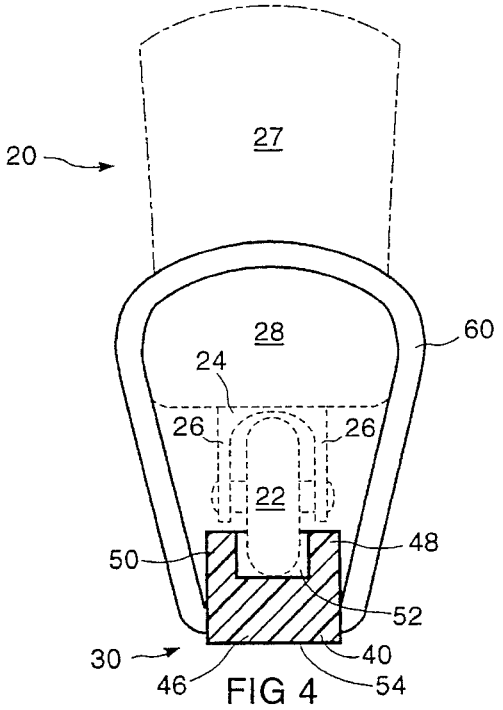
FIG. 4 is a sectional end elevation taken along section line 4—4 of FIG. 2.

DETAILED DESCRIPTION OF THE PREFERRED EMBODIMENTS:

Reference will now be made to FIGS. 1 through 4, which show a first preferred embodiment of the in-line roller skate guard 30 of the present invention—FIG. 1 shows the guard 30 alone, while FIGS. 2 through 4 show the guard 30 attached to an in-line roller skate 20 having a series of wheels 22 rotatably mounted in an in-line configuration on a wheel receiving frame 24. The wheel receiving frame 24 has two substantially parallel elongate rail portions 26 and is secured to a boot 27 having a toe portion 28 and a rear portion 29. A conventional static brake 21 extends outwardly and rearwardly from the rear portion 29 of the boot 27.

It can be seen that the guard 30 permits the wearer of the in-line roller skate 20 to be safely ambulant over the ground. For the purposes of this discussion, the ground will refer to any horizontal or nearly horizontal surface that one might wish to walk on including, grass, pavement, sidewalks, floors of buildings, stairs, and so on.

The guard 30 comprises a substantially rigid main body portion 40 having front end 42 and a back end 44. The main body portion 40 comprises a generally horizontally disposed substantially solid base member 46 that extends substantially the length of the guard 20 and is preferably made from a tough plastic material. Opposed left and right substantially rigid side walls 48, 50, extend upwardly from the generally horizontally disposed base member 46 so as to define a wheel receiving trough 52 above the generally horizontally disposed base member 46. The wheel receiving trough 52 is preferably slightly wider than a conventional in-line roller skate wheel. The height of the left and right substantially rigid side walls 48, 50 is less than the distance that the wheels 22 of the in-line roller skate 20 extend below the wheel receiving frame 24. In this manner, the wheel receiving frame 24 does not contact the left and right substantially rigid side walls 48, 50, when the guard 30 is in place on the in-line roller skate 20.

The main body portion 40 also has a ground contacting bottom surface 54 extending substantially the length of the main body portion 40 and having a width of about two inches, more or less, so as to provide lateral stability for the wearer while walking, and also permit the in-line roller skate 20 to be stored, when not in use, in a generally vertical upright position. In the preferred embodiment, the ground contacting bottom surface 54 has a plurality of indentations therein, as will be discussed in greater detail subsequently.

A first loop-shaped securing member 60 is operatively connected to the main body portion 40 near the front end 42 and is used to help attach the guard 30 to the in-line roller skate 20. In the first preferred embodiment as illustrated, the first loop-shaped securing member 60 is retained in secure yet removable relation in a selected one of the plurality of indentations 56 in the ground contacting bottom surface 54 of the main body portion 40. The first loop-shaped securing member 60 is oriented in upwardly projecting relation therefrom for looped engagement around the toe portion 28 of the boot 27 of the in-line roller skate 20. In this manner, the first loop-shaped securing member 60 can be positioned in any of the plurality of indentations 56 so as to accommodate nearly any size or shape of in-line roller skate 20. Preferably, the first loop-shaped securing member 60 is elastically deformable so as to permit ready placement of the first loop-shaped securing member 60 around the toe portion 28 of the boot 27 of the in-line roller skate 20, and to provide snug attachment of the guard 30 to the in-line roller skate 20.

Similarly, a second loop-shaped securing member 70 is operatively connected to the main body portion 40 near the back end 44 and is used to help attach the guard 30 to the in-line roller skate 20. The second loop-shaped securing member 70 is retained in secure yet removable relation in a selected one of the plurality of indentations 56 in the ground contacting bottom surface 54 of the main body portion 40. The second loop-shaped securing member 70 is oriented in upwardly and rearwardly projecting relation from the selected indentation 56 for looped engagement around the rear portion 29 of the boot 27 of the in-line roller skate 20. In this manner, the second loop-shaped securing member 70 can be positioned so as to accommodate nearly any size or shape of in-line roller skate 20. Preferably, the second loopshaped securing member 70 is elastically deformable so as to permit ready placement of the second loop-shaped securing member 70 around the rear portion 29 of the boot 27 of the inline roller skate 20, and to provide snug attachment of the guard 30 to the in-line roller skate 20.

The guard 30 further comprises forward blocking means 80 and rearward blocking means 82 disposed on the main body portion 40. In the first preferred embodiment, as illustrated, the forward blocking means 80 and rearward blocking means 82 are in the form of a plurality of integral blocking members 84, 86, 88, with each of the integral blocking members 84, 86, 88, being disposed between two contiguous wheels 22 of the in-line roller skate 20 when the guard 30 is in place on the in-line roller skate 20. It is also possible to have a single integral blocking member, if desired, disposed between two contiguous wheels of an in-line roller skate 20 when the guard 30 is in place on the in-line roller skate 20. There is also a front blocking member 90 disposed at the front end 42 of the main body portion 40, which front blocking member 90 forms a forward blocking means 80, and a rear blocking member 82 disposed at the back end 44 of the main body portion 40, which rear blocking member 92 forms a rearward blocking means 82.

Each of the integral blocking members 84, 86, 88 projects upwardly from the generally horizontally disposed base member 46, and they are preferably formed as an integral part thereof.

The integral blocking members 84, 86, 88 define depressions 83, 85, 87, 89 adjacent contiguous blocking members 84, 86, 88. The depressions 83, 85, 87, 89 are concavely curved and shaped so as to generally conform to the circumference of the wheels 22 of the in-line roller skate 20, which wheels 22 rest in the depressions 83, 85, 87, 89.

In use, when the guard 30 is in place on the in-line roller skate 20, the forward blocking means 80 and the rearward blocking means 82 are disposed forwardly and rearwardly, respectively, of the respective of the wheels 22 of the in-line roller skate 20 in intimately contacting relation therewith, so as to generally preclude fore and aft rolling motion, respectively, of the in-line roller skate 20 along the generally horizontally base member 46 of the in-line roller skate guard 30.

Figure 5:
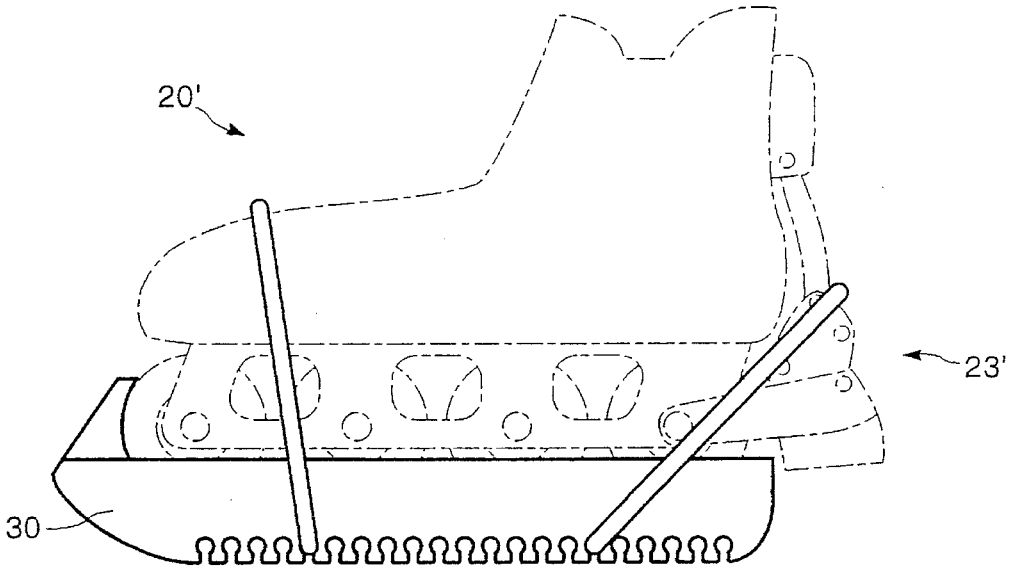
FIG. 5 is a side elevation view similar to FIG. 2, but with the in-line roller skate guard attached to a different kind of in-line roller skate having a brake actuating mechanism operatively mounted on the rear thereof.

Reference will now be made to FIG. 5, which show the first preferred embodiment in-line roller skate guard 30 of the present invention attached to an in-line roller skate 20', which skate 20' is substantially identical to the in-line roller skate 20 illustrated in FIGS. 2 through 4, except for a conventional dynamic brake 23' mounted thereon. It can be seen that the second loop-shaped securing member 70 loops around the conventional dynamic brake 23' in essentially the same manner as it loops around the rear portion 29 of the boot 27 of the inline roller skate 20, as shown in FIGS. 2 through 4.

Figure 6:
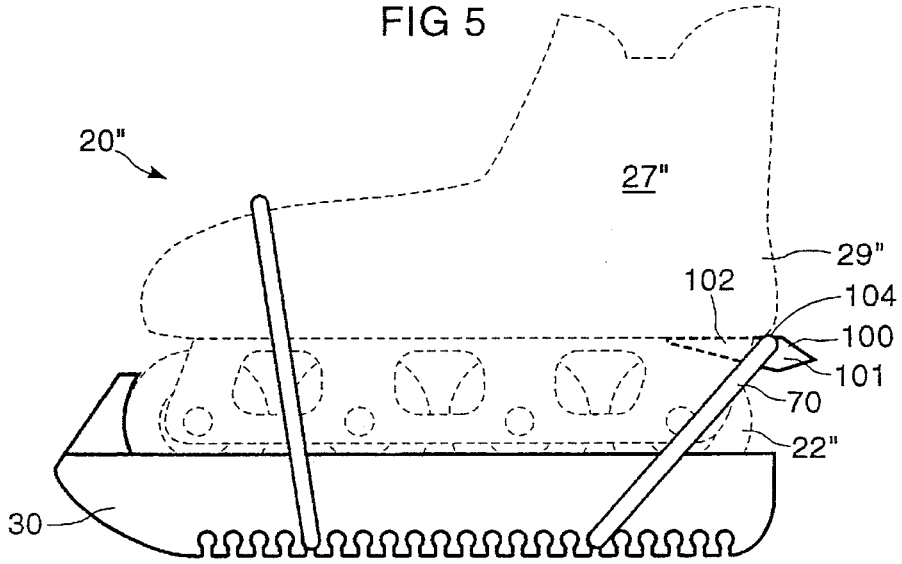
FIG. 6 is a side elevation of the guard of FIG. 1, also showing additional means of attaching the guard to an in-line roller skate having no rear mounted brake.
Figure 7:
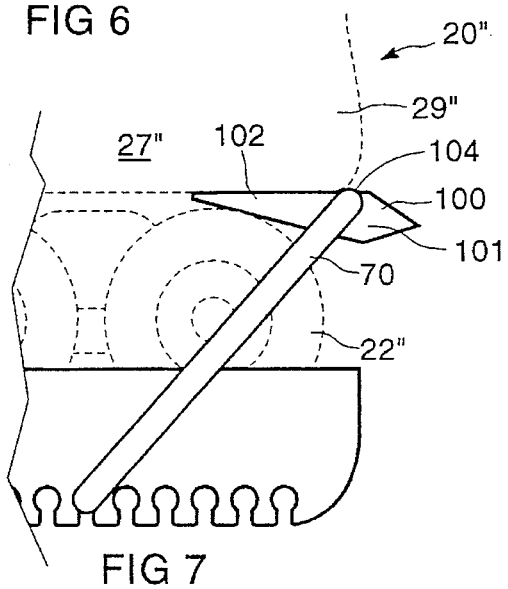
FIG. 7 is an enlarged side elevation of a portion of FIG. 6.
Figure 8:
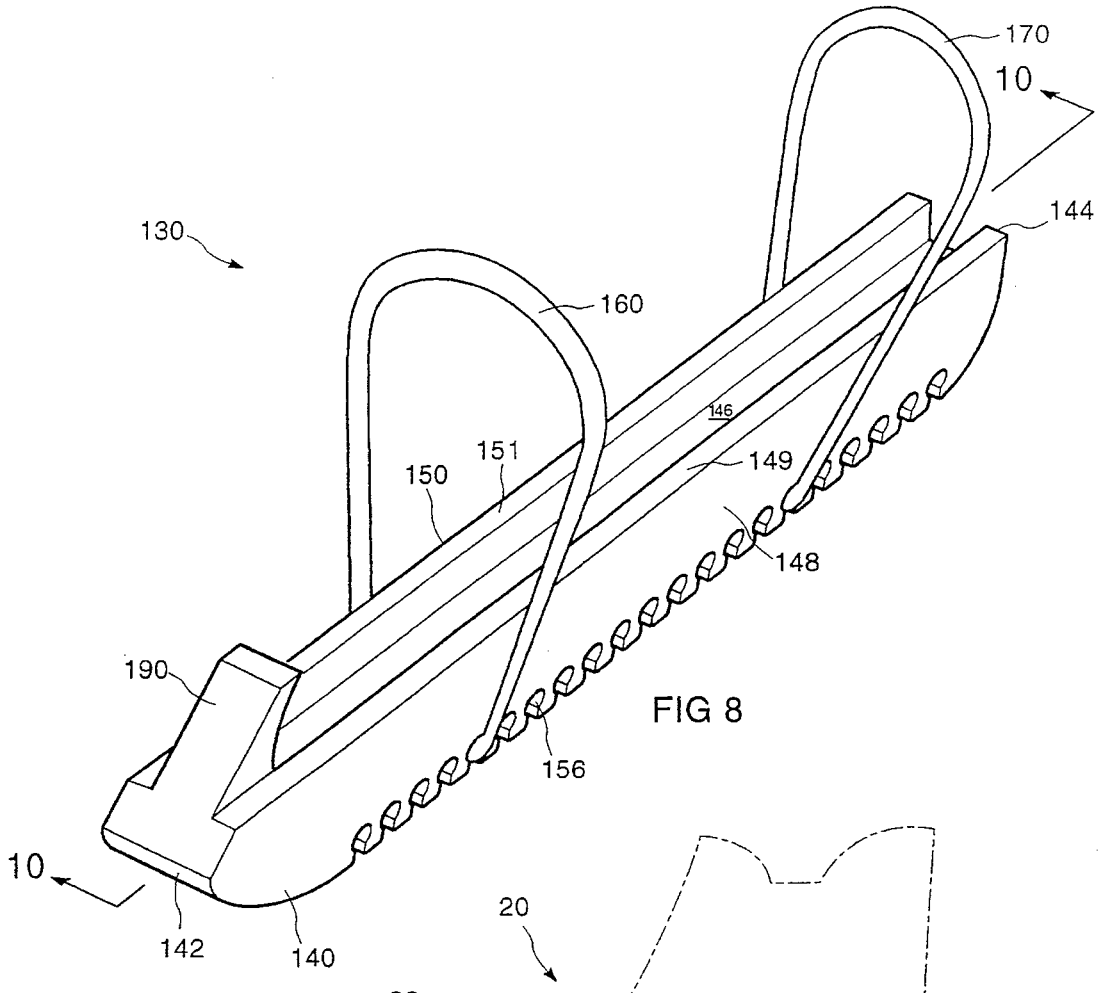
FIG. 8 is a perspective view from the front of a second preferred embodiment of the in-line roller skate guard of the present invention.
Figure 10:
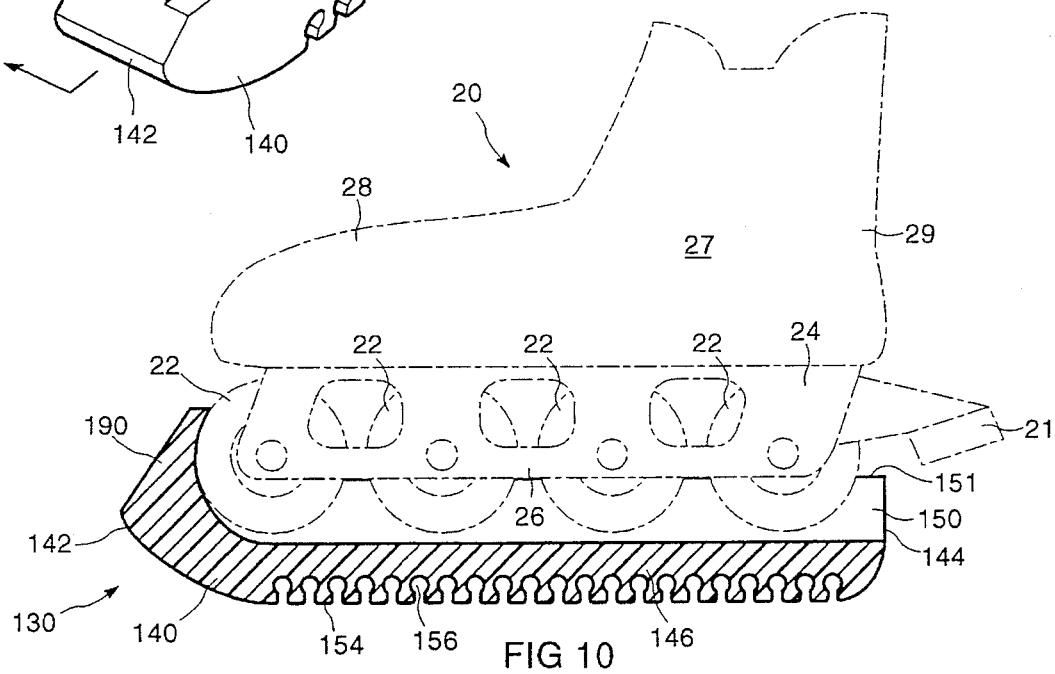
FIG. 10 is a sectional side elevation of the guard of Figure, taken along section line 10—10 of FIG. 8.
Figure 9:
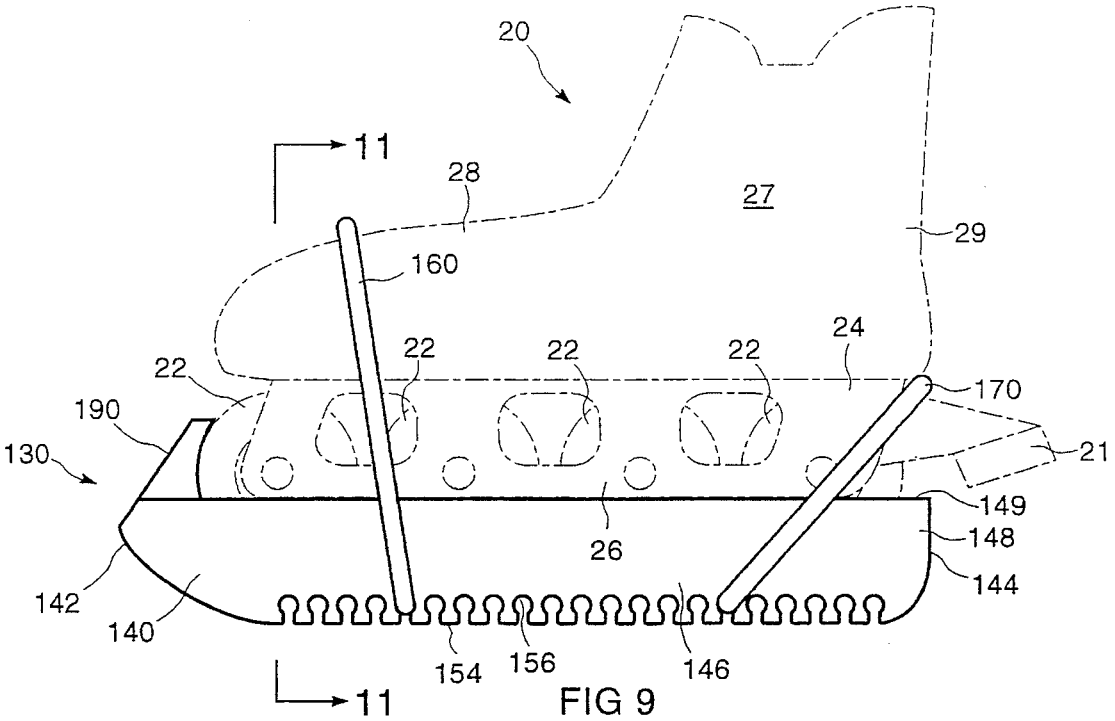
FIG. 9 is a side elevation of the guard of FIG. 8, attached to an in-line roller skate, with the in-line roller skate shown in ghost outline.
Figure 11:
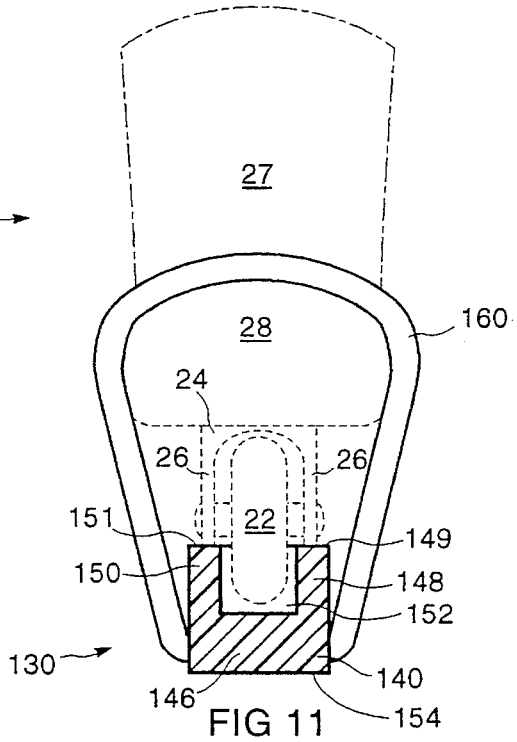
FIG. 11 is a sectional end elevation taken along section line 11—11 of FIG. 9.

Reference will now be made to FIGS. 6 and 7, which show the first preferred embodiment in-line roller skate guard 30 of the present invention attached to an in-line roller skate 20", which skate 20" does not have a brake mounted thereon. In this instance, a pin member 100 having a main body portion 101, a tapered front portion 102 and a notch 104 in the main body portion 101, is used to permit the second loop-shaped securing member 70 to securely attach to the rear portion 29" of the boot 27" of the skate 20". The tapered front portion 102 of the pin member 100 wedges between the rearmost wheel 22" and the bottom surface of the boot 27". The second loop-shaped securing member 70 is retained within the notch 104 of the pin member 100.

In an alternative embodiment, not illustrated, it is envisioned that the blocking members could be generally rectangular in shape, provided that the blocking members are high enough to preclude fore and aft rolling motion of an in-line roller skate that the guard is attached to.

In a second preferred embodiment, as illustrated in FIGS. 8 through 11, a guard 130 is attached to an in-line roller skate 20, which in-line roller skate 20 is detailed in the discussion of the first preferred embodiment. The guard 130 comprises a main body portion 140 having a front end 142 and a back end 144. The main body portion 140 comprises a generally horizontally disposed substantially solid base member 146, opposed left and right substantially rigid side walls 148, 150, extending upwardly from the generally horizontally disposed base member 146 so as to define a wheel receiving trough 152 above the generally horizontally disposed base member 146. There is also a ground contacting bottom surface 154 as part of the main body portion 140. A first loop-shaped securing member 160 and a second loop-shaped securing member 170 are retained by the guard 130 in selected indentations 156, in the same manner as the first loop-shaped securing member 60 and a second loop-shaped securing member 70 are retained in selected indentations in the guard 30 in the first preferred embodiment, and also function in the same manner.

The first and second side walls 148, 150 each comprise a substantially flat generally frictional top surface 149, 151, respectively, which generally frictional top surfaces 149, 151 are shaped to receive the elongate rail portions 26 of the wheel receiving frame 24 of the in-line roller skate 20. The left and right side walls 148, 150 define a wheel receiving trough 152 of a depth greater than the distance of downward projection of the wheels 22 from the elongate rail portions 26 of the wheel receiving frame 24, to thereby permit the generally frictional top surface 149, 151 to receive the elongate rail portions 26 of the wheel receiving frame 24 in weight bearing relation. In this manner, when a wearer of the in-line roller skate 20 with a guard 130 appropriately attached thereto, stands on the guard 130, the weight of the wearer is transmitted through the wheel receiving frame 24 of the skate 20 the left and right side walls 148, 150 of the guard 130. The wheels 22 of the skate 20 do not touch the base member 146. In this manner, the wheels 22 can not roll along the base member 146, so as to preclude fore and aft rolling motion of the in-line roller skate 20. A front blocking member 190 is disposed at the front end 142 of the main body portion 140, which front blocking member 190 helps preclude the in-line roller skate 20 from moving forwardly with respect to the guard 130.

Other modifications and alterations may be used in the design and manufacture of the apparatus of the present invention without departing from the spirit and scope of the accompanying claims.

What is claimed is:

1. A guard for use on an in-line roller skate having a series of wheels rotatably mounted in an in-line configuration on a wheel receiving frame having two substantially parallel elongate rail portions and being secured to a boot having a toe portion and a rear portion, said guard permitting the wearer of an in-line roller skate to be safely ambulant and comprising:

a main body portion having a front end and a back end and comprising a generally horizontally disposed substantially solid base member, opposed left and right substantially rigid side walls extending upwardly from said generally horizontally disposed base member so as to define a wheel-receiving trough above said generally horizontally disposed base member, and a ground contacting bottom surface;

a first loop-shaped securing member operatively connected to said main body portion, such that when said guard is in place on said in-line roller skate, said first loop-shaped securing member is oriented in upwardly projecting relation for looped engagement around the toe portion of the boot of an in-line roller skate;

a second loop-shaped securing member operatively connected to said main body portion, such that when said guard is in place on said in-line roller skate, said second loop-shaped securing member is oriented in upwardly and rearwardly projecting relation for looped engagement around the rear portion of the boot of an in-line roller skate;

wherein, when said guard is in place on said in-line roller skate, at least one of said first and second loop-shaped securing members is elastically deformable so as to provide snug attachment of said guard to an in-line roller skate; and forward and rearward blocking means extending upwardly from said base member such that when said guard is in place on said in-line roller skate, said forward and rearward blocking means are disposed forwardly and rearwardly, respectively, of at least one of the wheels of said in-line roller skate in intimately contacting relation therewith, so as to generally preclude fore and aft rolling motion, respectively, of said in-line roller skate along said generally horizontally disposed base member of the guard.

2. The guard of claim 1, wherein said forward and rearward blocking means comprise a single integral blocking member disposed between two contiguous wheels of an in-line roller skate, when said guard is in place on an in-line roller skate.

3. The guard of claim 2, wherein said single integral blocking member projects upwardly from said generally horizontally disposed base member.

4. The guard of claim 1, wherein said forward and rearward blocking means comprises a series of blocking members, each blocking member being disposed individually between two contiguous wheels of said in-line roller skate, when said guard is in place on said in-line roller skate.

5. The guard of claim 4, wherein said blocking members each projects upwardly from said generally disposed base member.

6. The guard of claim 5, wherein said blocking members define depressions between contiguous blocking members, with said depressions being concavely curved in shape so as to generally conform to the circumference of the respective wheel of an in-line roller skate.

7. The guard of claim 1, wherein said first loop-shaped securing member is operatively connected to said main body portion near the front end thereof, and said second loop-shaped securing member is operatively connected to said main body portion near the back end thereof.

8. The guard of claim 1, further comprising a pin member having a main body portion, a tapered front portion shaped and dimensioned to be wedged between the rearmost wheel and the bottom surface of the boot of an in-line roller skate, and a notch in said main body portion, said notch being shaped and dimensioned to receive said second loop-shaped securing member therein.

9. The guard of claim 1, wherein each of said first and second loop-shaped securing members is elastically deformable.

10. The guard of claim 1, wherein said generally horizontally disposed base member extends substantially the length of said guard.

11. The guard of claim 1, wherein said forward blocking means further comprises a front blocking member disposed at the front of said main body portion.

12. The guard of claim 1, wherein said main body portion is substantially rigid.

13. The guard of claim 1, wherein said ground contacting bottom surface has a width of about three inches or greater.

14. The guard of claim 1, wherein said ground contacting bottom surface has a plurality of indentations therein, said indentations being shaped and dimensioned to receive said first and second loop-shaped securing members therein in secure yet removable relation.

15. A guard for use on an in-line roller skate having a series of wheels rotatably mounted in an in-line configuration on a wheel receiving frame having two substantially parallel elongate rail portions and being secured to a boot having a toe portion and a rear portion, said guard permitting the wearer of an in-line roller skate to be safely ambulant and comprising:

a main body portion having a front end and a back end and comprising a generally horizontally disposed substantially solid base member, opposed left and right substantially rigid side walls extending upwardly from said generally horizontally disposed base member so as to define a wheel-receiving trough above said generally horizontally disposed base member, and a ground contacting bottom surface;

a first loop-shaped securing member operatively connected to said main body portion, such that when said guard is in place on said in-line roller skate, said first loop-shaped securing member is oriented in upwardly projecting relation for looped engagement around the toe portion of the boot of an in-line roller skate;

a second loop-shaped securing member operatively connected to said main body portion, such that when said guard is in place on said in-line roller skate, said second loop-shaped securing member is oriented in upwardly and rearwardly projecting relation for looped engagement around the rear portion of the boot of an in-line roller skate;

wherein, when said guard is in place on said in-line roller skate, at least one of said first and second loop-shaped securing members is elastically deformable so as to provide snug attachment of said guard to an in-line roller skate; and a pin member having a main body portion, a tapered front portion shaped and dimensioned to be wedged between the rearmost wheel and the bottom surface of the boot of an in-line roller skate when said guard is in place on said in-line roller skate, and a notch in said main body portion, said notch being shaped and dimensioned to receive said second loop-shaped securing member therein.

16. The guard of claim 15, wherein said first and second side walls each comprise a generally frictional top surface shaped to receive said elongated rail portions of said wheel receiving frame of said skate and define said wheel-receiving trough to be of a depth greater than the distance of downward projection of said wheels from said elongate rail portions said wheel receiving frame, to thereby permit said generally frictional top surface to receive said elongate rail portion of said wheel receiving frame in weight bearing relation, wherein said generally frictional top surface is substantially flat on each of said first and second side walls.

* * * * *